United States Patent [19]

Angelino

[11] 4,122,622

[45] Oct. 31, 1978

[54] DOUBLE ACTION REVOLVER HAMMER

[76] Inventor: Ralph J. Angelino, Box 173, 16 Leets Island Rd., Bramford, Conn. 06405

[21] Appl. No.: 756,769

[22] Filed: Jan. 5, 1977

[51] Int. Cl.[2] ..... F41C 19/00

[52] U.S. Cl. ..... 42/65; 42/69 R

[58] Field of Search ..... 42/65–67, 42/59, 69 R, 69 B

[56] References Cited

U.S. PATENT DOCUMENTS

| | | | |
|---|---|---|---|
| 246,817 | 9/1881 | Proeschel | 42/66 |
| 311,323 | 1/1885 | Hopkins | 42/66 |
| 1,042,007 | 10/1912 | Key | 42/65 |

*Primary Examiner*—Charles T. Jordan

*Attorney, Agent, or Firm*—Watson, Leavenworth, Kelton & Taggart

[57] ABSTRACT

A double action hammer for a revolver including a link pivotably mounted off center in a groove in the top of the hammer so that when pivoted from the groove to an exterior position relative to the groove it will be locked in place and will move the hammer to cock the trigger of the revolver for quick action. A leaf spring is embedded in the hammer between a wall of the groove and the bottom of the link to aid in pivoting the link to a closed position. In its closed position in the groove, the link has an outer surface contiguous with the outer edge of the hammer so that when the revolver is placed in a pocket, it will not snag on the clothes of the user enabling ready removal of the revolver.

10 Claims, 2 Drawing Figures

DOUBLE ACTION REVOLVER HAMMER

PRIOR ART

The following patents are considered pertinent: U.S. Pat. No. 1,049,106 U.S. Pat. No. 1,049,105 U.S. Pat. No. 1,042,007 U.S. Pat. No. 3,269,045 U.S. Pat. No. 3,613,286

BACKGROUND OF THE INVENTION

This invention relates to a revolver and more particularly, a revolver hammer provided with double action.

The present invention is concerned with a revolver wherein the required actuation of the firing mechanism to produce a shot or several shots following each other takes place by operating a trigger. However, to place a well-aimed single shot, it is possible to cock the trigger of the firearm by means of a hammer and then release it by a considerably small movement of the trigger. Such firearms are commonly referred to as double action firearms.

In order to provide a double action firearm in existing revolver constructions, the hammer used to ignite the cartridge projects from the firing mechanism above the handle and can be moved by the thumb out of a rest position to a cocking position ready for firing so that only a small amount of the trigger movement is necessary to discharge the firearm. To provide a sufficient engaging surface for the thumb of the hand holding the hammer and to assure a secure swing actuation into the cocking position, a part of the hammer fully projects out of the hammer as an actuating lug.

While such a construction has the aforementioned advantages of producing a shot or several shots following each other in rapid succession, such a revolver suffers from drawbacks in that the revolver with its lug or hammer can be caught in the lining of a coat or trouser pocket, thereby preventing the pulling of the firearm and defeating the entire purpose of the double action revolver.

This invention provides a link mechanism for converting a single action revolver hammer to a double action revolver hammer so that the trigger can be quickly cocked, and returned, if necessary, to a flat rest position on the hammer wherein no projections extend from the revolver handle or hammer to snag on a coat or trouser pocket.

SUMMARY OF THE INVENTION

In accordance with a particularly preferred embodiment of the invention, the link has an arcuate bottom edge which is mounted off-center in a groove in the top of the revolver hammer. Upon pivotal movement of the link from a closed position within the groove to an open position, wherein the link extends outwardly of the hammer and is locked in the groove, the hammer is cammed and the trigger is cocked to a quick release or second action position. A leaf spring is provided in the bottom of the groove so that when the link is pivoted in an opposite direction, the leaf spring will aid in returning the link to its closed position within the groove which is contiguous with the outer surface of the hammer, so when a revolver is placed in a pocket, there will be no extremities which could snag on the clothing of the user. In addition, the leaf spring also aids in keeping the link in both an open and closed position.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
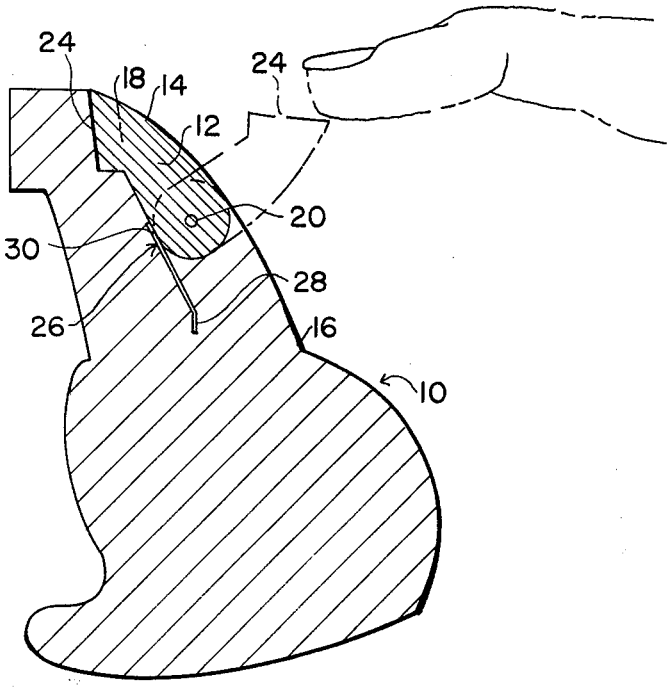
FIG. 1 is a longitudinal cross-sectional view of the hammer of a revolver provided with the double action link mechanism of the present invention, shown in a closed position and in an open position in phantom lines to cock the trigger of the revolver.
Figure 2:
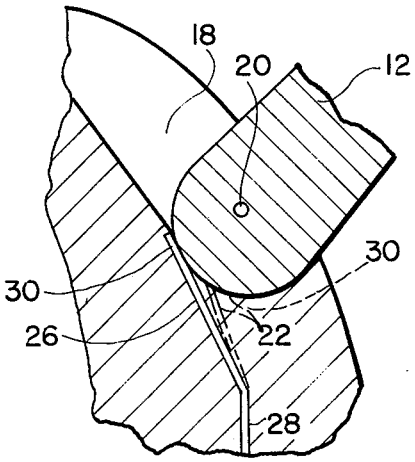
FIG. 2 is an enlarged detailed view of a portion of the mechanism of FIG. 1, and further illustrating in phantom lines the action of the return spring for the link.

Referring now to the drawing in detail, wherein like numerals indicate like elements throughout the several views, FIG. 1 illustrates a hammer 10 of a single action revolver modified in accordance with the present invention to furnish double action.

A link 12 having an outer edge 14 contiguous with the outer edge 16 of hammer 10 is pivotally mounted within a groove 18 in hammer 10 by a pin 20 inserted off center with respect to the arcuate lower edge 22 of link 12. The top of link 12 includes a substantially flat or planar surface 24.

Disposed within the bottom of the groove 18 is a leaf spring 26 having an end 28 embedded within the hammer 10 and a free end 30 between the lower arcuate edge 22 of link 12 and a wall of groove 18. Link 12 can be pivoted from its closed position shown in FIG. 1 to an open position showing phantom lines in FIG. 1 to cock the trigger of the revolver for quick action. When link 12 is pivoted to the open position illustrated, its eccentric or off-center mounting locks arcuate edge 22 agains the bottom of groove 18, depressing free end 30 of leaf spring 26. This has the effect of camming hammer 10 backwards (which is connected to the trigger) to cock the trigger. Slight finger pressure on the trigger will then fire the revolver. It is to be noted, as is self evident from the Figures, that leaf spring 26 also acts to maintain the link in an open locked position by exerting an upward force against the lower edge of the link.

In order to store link 12 and revert revolver back to its single action mode, the link 12 is unlocked and rotated in a counterclockwise direction as viewed in FIG. 1. Slight movement of link or spur 12 in a counterclockwise direction enables free end 30 of leaf spring 26 to complete and aid the rotative movement of link 12 to its closed position as shown in FIG. 1. In this position, the revolver can be conveniently stored within a pocket without fear of it being snagged upon removal. As is clear from the Figures, leaf spring 26 also aids in keeping the link in a closed position by exerting a force against the inner side of the link.

While a specific embodiment of a double action revolver hammer has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A double action revolver hammer comprising:

(a) a hammer, (b) a groove situated in said hammer, and (c) a link, mounted in said groove, pivotable from a closed unlocked position to an open locked position and capable of remaining in said open locked position or closed unlocked position, said link, when pivoted to an open locked position, is capable of imparting movement to said hammer to cock a trigger of the revolver.

2. The hammer of claim 1 which further includes a means for keeping the link in said open locked position.

3. The hammer of claim 1 which further includes a means for keeping the link in said closed unlocked position.

4. The hammer of claim 2 wherein the means for keeping the link in an open position is comprised of mounting said link in the groove in a manner such that when the link is pivoted to a position extending exteriorly of said groove, the link will be wedged against at least one wall of the groove thereby locking the link in an open position.

5. The hammer of claim 2 wherein the means for keeping the said link in an open position is comprised of a leaf spring situated in the groove having a freely movable portion between one end of the link and a wall of the groove such that a force is created by the leaf spring against the link acting to keep the link in an open position.

6. The hammer of claim 3 wherein the means for keeping the said link in a closed unlocked position is comprised of a leaf spring situated in the groove having a freely movable portion between the link and a wall of the groove such that a force is created by the leaf spring acting to maintain pressure against the link.

7. The hammer of claim 1 wherein the link has at least a portion of a surface contiguous with the surface of said hammer when the link is positioned in an unlocked position within the groove.

8. The hammer of claim 1 which further includes a means for aiding in the return of the link from a locked to an unlocked position.

9. The hammer of claim 8 wherein the said means comprises a leaf spring situated in the groove having a freely movable portion between the link and a wall of said groove.

10. A double action revolver hammer comprising:

(a) a hammer, (b) a groove situated in said hammer, (c) a pivotable link having an arcuate lower edge mounted eccentrically in said groove such that when pivoted to a position extending exteriorly of said groove said link will impinge against a wall of said groove and will be capable of imparting movement to said hammer to cock a trigger of a revolver, and (d) a spring situated in the groove having a freely movable portion between the link and a wall of the groove such that it i. aids in the return of said link from a locked to an unlocked position, ii. keeps the link in an open locked position, and iii. keeps the link in a closed unlocked position, said link having at least a portion of a surface contiguous with the surface of said hammer when the link is positioned in an unlocked position within the groove.

* * * * *